US008006343B2

(12) United States Patent
Lee

(10) Patent No.: US 8,006,343 B2
(45) Date of Patent: Aug. 30, 2011

(54) DUSTER FOR VEHICLE

(76) Inventor: Pil-Hee Lee, Chungcheongbuk-do (KR)

( * ) Notice: Subject to any disclaimer, the term of this patent is extended or adjusted under 35 U.S.C. 154(b) by 975 days.

(21) Appl. No.: 11/668,015

(22) Filed: Jan. 29, 2007

(65) Prior Publication Data

US 2008/0005862 A1 Jan. 10, 2008

(30) Foreign Application Priority Data

Jul. 4, 2006 (KR) ..... 10-2006-0062368

(51) Int. Cl.
*A47L 13/10* (2006.01)

(52) U.S. Cl. ..... 15/226; 15/229.2; 15/210.1; 15/146

(58) Field of Classification Search ..... 15/225, 15/226, 229.2, 229.1, 209.1, 210.1, 147.1, 15/146

See application file for complete search history.

(56) References Cited

U.S. PATENT DOCUMENTS

| | | | | |
|---|---|---|---|---|
| 4,305,173 | A * | 12/1981 | Isao | 15/1.52 |
| 5,346,287 | A * | 9/1994 | Burrow et al. | 300/21 |
| 7,478,453 | B1 * | 1/2009 | Busshaus | 15/228 |
| 2004/0243036 | A1 * | 12/2004 | Ma Ki et al. | 601/135 |

FOREIGN PATENT DOCUMENTS

| | | |
|---|---|---|
| KR | 20-0258546 | 12/2001 |
| KR | 20-0386161 | 5/2005 |

OTHER PUBLICATIONS

Kim, W.Y., et al., "The Changes of Vulcanization and Physico-Mechanical Properties of NR/BR Blend with the Content of Sulfur and Accelerator." Dec. 1991. *Journal of Korean Ind. & Eng. Chemistry*, vol. 2, No. 4, pp. 356-362.

* cited by examiner

*Primary Examiner* — Shay Karls
(74) *Attorney, Agent, or Firm* — Ladas & Parry LLP

(57) ABSTRACT

There is provided a duster which is suitable for cleaning. To prevent a brush wound around a rod from slipping in the direction of the length and the direction of the axial rotation of the rod, the duster comprises: a number of sharp protrusions formed on a portion of the rod around which the brush is wound, so that a stitched portion of the brush is stuck to the sharp protrusions to semi-permanently prevent the slip of the brush, thereby maintaining the product to be like a first assembled state thereof, preventing the function of the duster from being deteriorated, and preventing the surface of an object to be cleaned from being scratched by the rod which is partially exposed. In addition, since the slip of the brush is prevented by using no adhesive agent, the product is easily assembled and the cost is greatly reduced accordingly.

13 Claims, 13 Drawing Sheets

DUSTER FOR VEHICLE

CROSS-REFERENCE TO RELATED APPLICATION

This application claims the benefit of Korean Patent Application No. 10-2006-0062368, filed Jul. 4, 2006, the disclosure of which is hereby incorporated herein by reference in its entirety.

BACKGROUND OF THE INVENTION

1. Technical Field

The present invention relates to a duster which is suitable for cleaning, and, more particularly, to a duster which is significantly improved to prevent a brush secured to a rod from slipping in the direction of the length of the rod and in the direction of the axial rotation of the rod, thereby preventing many problems due to the slip of the brush.

2. Discussion of Related Art

Generally, a duster comprises a brush, and a rod which the brush is secured to and functions as a handle.

The aforementioned duster can be differently used according to materials of a brush. For example, when the duster includes a brush made of light filaments or plastic filaments, it is usually used to remove or sweep dust which is present on windows, sofas, electronic products and living room furniture at home. When the duster includes a brush made of mainly filaments with oil or wax, it is usually used to sweep dust which is present on transportation vehicles, such as cars or motorcycles. As examples of a rod, there are a product formed by injecting plastics and a product made of wood. The product has a rod shape in appearance. A brush is wound around the circumference of a rod, at a predetermined length, except for a handle of the rod, so that the brush is used in all directions, at 360 degrees.

As described above, the present invention provides a duster which is suitable for dusting transportation vehicles or at home.

In a duster for transportation vehicles, such as cars, a brush formed by stitching a plurality of filaments is wound about a portion of a rod, except for a handle. When using the duster in this constitution, a user holds the handle to move forwardly and backwardly or side to side in the direction of the length of the rod. Then, when using the brush wound around the rod, for a long time, a slip occurs in the direction of the length of the rod (forward/backward directions) and the direction of the axial rotation of the rod (right/left directions), so that the brush leans toward any one side. As a result, since the brush becomes entangled or comes loose, the function of the duster deteriorates and a part of the rod is exposed to scratch a car surface.

To prevent the brush from slipping in the direction of the length of the rod or in the direction of the axial rotation of the rod, an inventor of the present invention provides a duster in which a number of sharp protrusions are formed on the portion of the rod around which the brush is wound, so that the stitched portion of the brush is stuck to the sharp protrusions and the brush is wound around the rod, thereby semi-permanently preventing the slip of the brush. Consequently, the duster can be maintained like a first assembled state of the product, the function of the brush is prevented from being deteriorated, and further the surface of a car is prevented from being scratched by the rod partially exposed. Further, since the slip of the brush is prevented by using no adhesive agent, the product is easily assembled and thus the cost is greatly reduced.

Conventional dusters will be described with reference to the drawings.

FIGS. 1 through 3 illustrate conventional dusters disclosed in Korean Utility Model Registration No. 386151 (May 30, 2005) by KIM, YongJun and Korean Utility Model Registration No. 258546 (Dec. 11, 2001) by NOH, SangWan.

In FIG. 1, a duster 100 comprises a rod 110 including a handle, and a brush 120 being wound around a predetermined portion of the rod 110.

As illustrated in FIG. 2, the rod 110 comprises a handle part 112 and a brush securing part 114. A number of ring-shaped grooves 114*a* are formed, spaced apart from one another, at a predetermined interval, in the direction at a right angle with an axis of the rod, on the surface of the brush securing part 114. As illustrated in an assembling process of FIG. 3, the brush 120 is made of a plurality of filaments. A stitching line 120*a* is formed at one end of the brush 120. The brush 120 is secured, by being wound around the brush securing part 114 of the rod 110. Then, the stitching line 120*a* is directly in contact with the brush securing part 114 of the rod 110 and is wound around the brush securing part 114, so that the stitching line 120*a* is secured to the ring-shaped grooves 114*a*.

In the above-described conventional duster 100, when using the duster 100 for a long time, the brush 120 is prevented from slipping in the direction of the length (L) of the rod 110, by the ring-shaped grooves 114*a*.

However, the structure of the ring-shaped grooves 114*a* is incapable of preventing the brush 120 from slipping in the direction of the axial rotation (R). When the brush 120 is used for a long time, the filaments become loose. The conventional duster 100 does not have any structural method to prevent the loose filaments from slipping in the direction of the axial rotation (R) when the filaments are rotated in the direction of the axial rotation (R) of the ring-shaped grooves 114*a*.

Therefore, the above-mentioned inventors of the conventional dusters use an adhesive agent to prevent the slip of the brush 120 in the direction of the axial rotation (R). That is, the brush 120 is securely fixed to the brush securing part 114 of the rod 110, by applying the adhesive agent to the ring-shaped grooves 114*a* and subsequently attaching the stitching line 120*a* to the ring-shaped grooves 114*a*.

As described above, the conventional duster is capable of structurally preventing the slip of the brush in the direction of the length of the rod, by using the ring-shaped grooves. However, since the conventional duster does not structurally solve the slip of the brush in the direction of the axial rotation, it additionally uses the adhesive agent to solve the slip of the brush in the direction of the axial rotation. Therefore, the conventional duster has the problems in that it is difficulty to assemble the product by the adhesive agent, the time and cost for assembling the product are added, and thus, the manufacturing cost of the product is increased.

SUMMARY OF THE INVENTION

Therefore, the present invention is directed to provide a duster which sufficiently prevents a brush from slipping in the direction of the length of a rod and the direction of the axial rotation thereof, without using an adhesive agent, unlike a conventional duster, in spite of a long time of use of the duster. Accordingly, an assembling process is simplified to improve the productivity, the environment-friendly product is realized by using no adhesive agent, and thus the cots is drastically reduced.

Another object of the present invention is to provide a duster which includes a rod made of not only plastics but also wood or metal materials, thereby producing the diversity of the product.

Another object of the present invention is to provide a duster which is capable separating a handle part of a rod from a brush securing part of the rod, considering the economical efficiency in packing.

Exemplary embodiments of the present invention provide a duster.

In accordance with an exemplary embodiment, a duster comprises a rod including a handle part and a brush securing part; and a brush being secured to the brush securing part of the rod; and the duster is characterized in that: a number of protrusions are protruded from the outer surface of the brush securing part of the rod, to be formed in one body with the brush securing part; and a stitching line of the brush is stuck to the protrusions, to be wound around the brush securing part, so that the brush is prevented from slipping in the direction of the length and in the direction of the axial rotation of the rod.

In an exemplary embodiment, a duster which comprises a rod including a handle part and a brush securing part; and a brush being secured to the brush securing part of the rod, and the duster is characterized in that: a wraparound sheet is attached to the outer surface of the brush securing part of the rod; a number of protrusions are protruded from the surface of the wraparound sheet; a stitching line of the brush is stuck to the protrusions, to be wound around the brush securing part, so that the brush is prevented from slipping in the direction of the length and in the direction of the axial rotation of the rod.

In accordance with another exemplary embodiment, a duster comprises a rod including a handle part and a brush securing part; and a brush being secured to the brush securing part of the rod, and the duster is characterized in that a tube-type brush securing case is attached to cover the outer surface of the brush securing part of the rod; a number of protrusions are protruded from the surface of the brush securing case; a stitching line of the brush is stuck to the protrusions, to be wound around the brush securing part, so that the brush is prevented from slipping in the direction of the length and in the direction of the axial rotation of the rod.

The protrusions may be conical sharp protrusions.

The protrusions may be cylindrical protrusions.

In accordance with a modified example of the embodiment of the present invention, the duster is characterized in that: two level parts are formed to be parallel to each other and lengthwise, on the brush securing part of the rod, so that the brush wound around the brush securing part is tightly secured to the rod.

The handle part and the brush securing part of the rod may be formed in one body or may be formed to be separate from each other.

The rod may be made of plastics, wood or metal.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF EXAMPLE EMBODIMENTS OF THE PRESENT INVENTION

The present invention will now be described more fully hereinafter with reference to the accompanying drawings, in which preferred embodiments of the invention are shown.

It will be understood that terms used in the present application and claims shall not be interpreted as the meaning defined in commonly used dictionaries. It will be further understood that the terms should be interpreted as having a meaning that is consistent with their meaning in the context of the relevant art and the technical idea of the invention, based on the principle that an inventor may properly define the meaning of the terms to best explain the invention.

This invention may be embodied in different forms and should not be construed as limited to the embodiments set forth herein. Rather, these embodiments are provided as teaching examples of the invention. Therefore, it will be understood that the scope of the invention is intended to include various modifications and alternative arrangements within the capabilities of persons skilled in the art using presently known or future technologies and equivalents.

Exemplary Embodiments

Figure 4A:
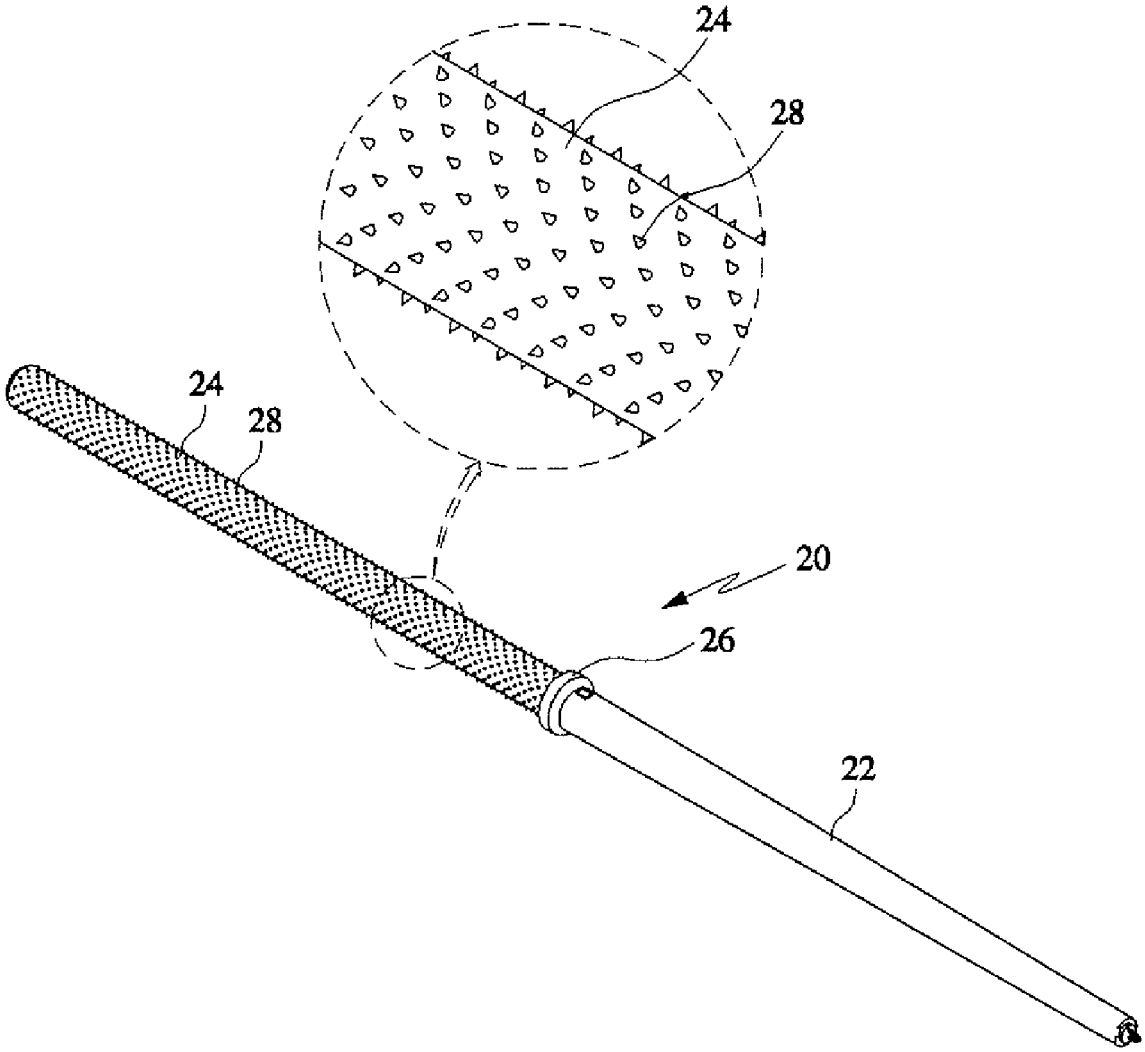
FIG. 4A is a perspective view of a rod of a duster according to a first embodiment of the present invention.

FIG. 4A is a perspective view of a rod of a duster according to a first embodiment of the present invention.

Reference numeral 20 indicates the entire rod. A handle part 22 is formed at one end of the rod 20, and a brush securing part 24 is formed at the other end of the rod 20. A brush cover 26 is formed at the boundary between the handle part 22 and the brush securing part 24. The brush cover 26 covers a side of a brush 120. A number of conical sharp protrusions 28 are formed on the outer surface of the brush securing part 24. The sharp protrusions 28 protrude from the brush securing part 24, to be formed in one body with the brush securing part 24.

Preferably, the sharp protrusions 28 may be formed throughout the outer circumferential surface of the brush securing part 24 and may protrude from the outer surface of the brush securing part 24, at a suitable protrusion height, so that a stitching line 120*a* of the brush 120 is stuck to the sharp protrusions 28.

Further, the sharp protrusions 28 may be conical in shape so as to be stuck by the stitching line 120*a*. However, the sharp protrusions are not limited to the conical shape and they may have any other shape suitable for being stuck by the stitching line 120*a*. For example, the exterior shape of the protrusion may be cylindrical if needed.

Figure 4B:
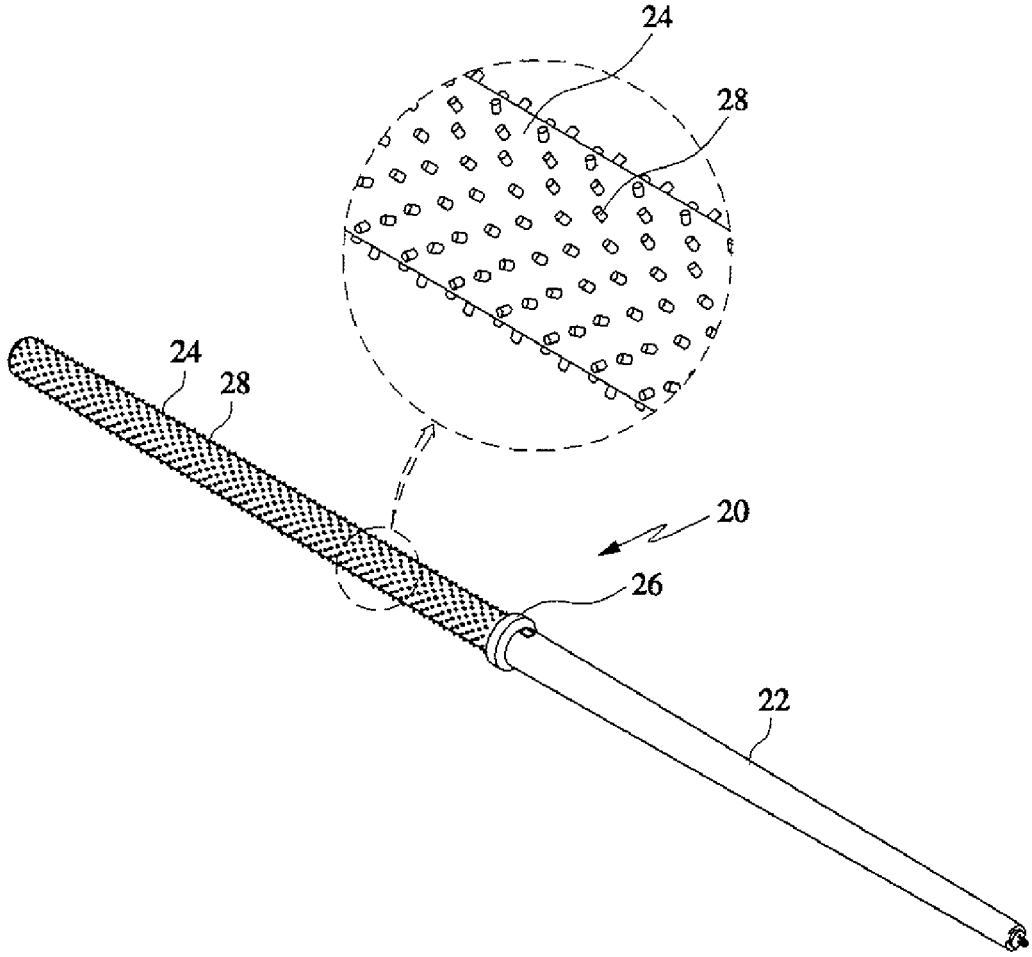
FIG. 4B is a perspective view of a modified example of the rod of FIG. 4A.

That is, as illustrated in FIG. 4B, the cylindrical protrusions 28 may be formed on the brush securing part 24. The stitching line 120*a* of the brush 120 made of filaments is well stuck to the cylindrical protrusions 28. Compared to the conical sharp protrusions 28, the cylindrical protrusions 28 more surely prevent a slip of the brush 120 because the stitching line 120*a* is stuck to the cylindrical protrusions 28 at a right angle.

The aforementioned cylindrical projections may be round or polygonal.

Figure 5A:
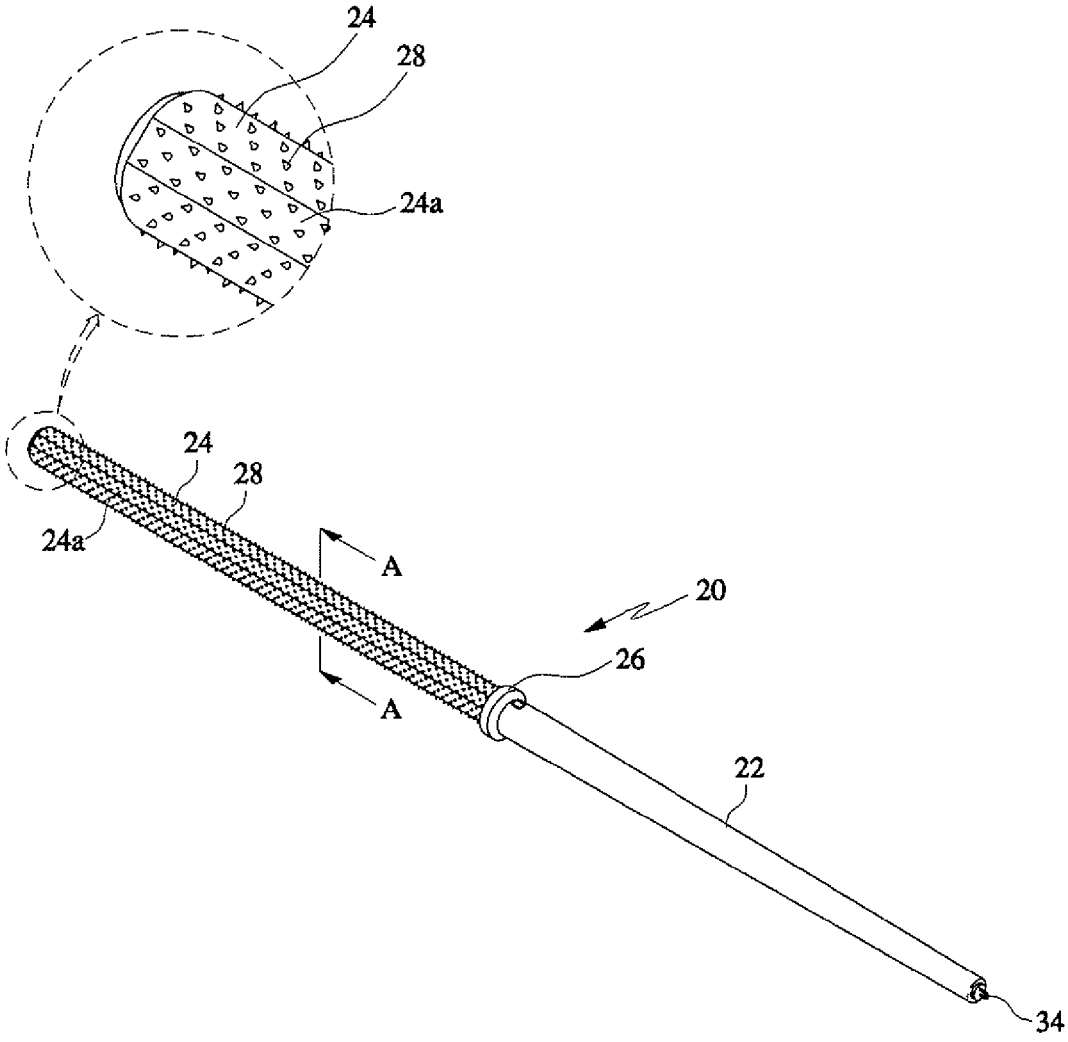
FIG. 5A is a perspective view of a modified example of the rod of FIG. 4A.
Figure 5B:
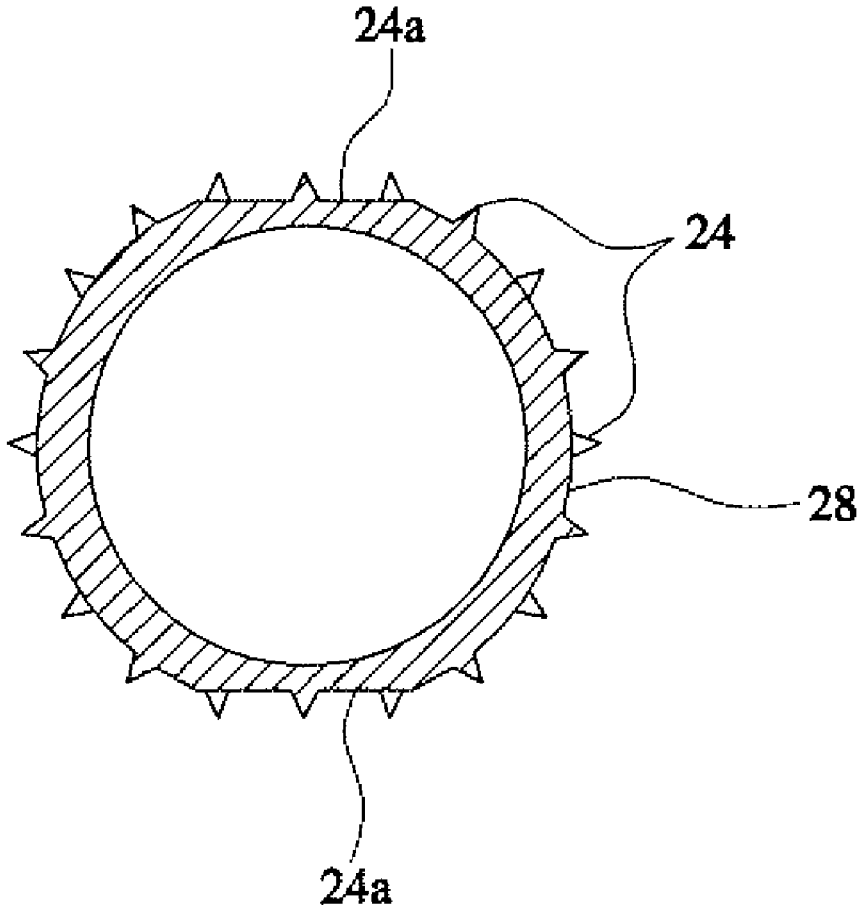
FIG. 5B is a sectional view taken along Line A-A of FIG. 5A.

FIGS. 5A and 5*b* illustrate modified examples of the rod 20. Two level parts 24*a* are formed on the circumference of the brush securing part 24, lengthwise, as shown. The level parts 24*a* are parallel to each other. When the stitching line 120*a* of the brush 120 is secured by being wound around the brush securing part 24, the stitching line 120*a* contacts with and passes through the level portions 24*a*, so that the stitching line 120*a* forms to be level as wide as the width of one level part 24*a* and forms to be round, and it again forms to be level and round, to be wound around the brush securing part 24. When the stitching line 120*a* is wound in the aforementioned manner, the level parts 24*a* supports a pulling force of the stitching line 120*a*, thereby more tightly securing the brush 120 around the brush securing part 24 to the rod 20.

Figure 6:
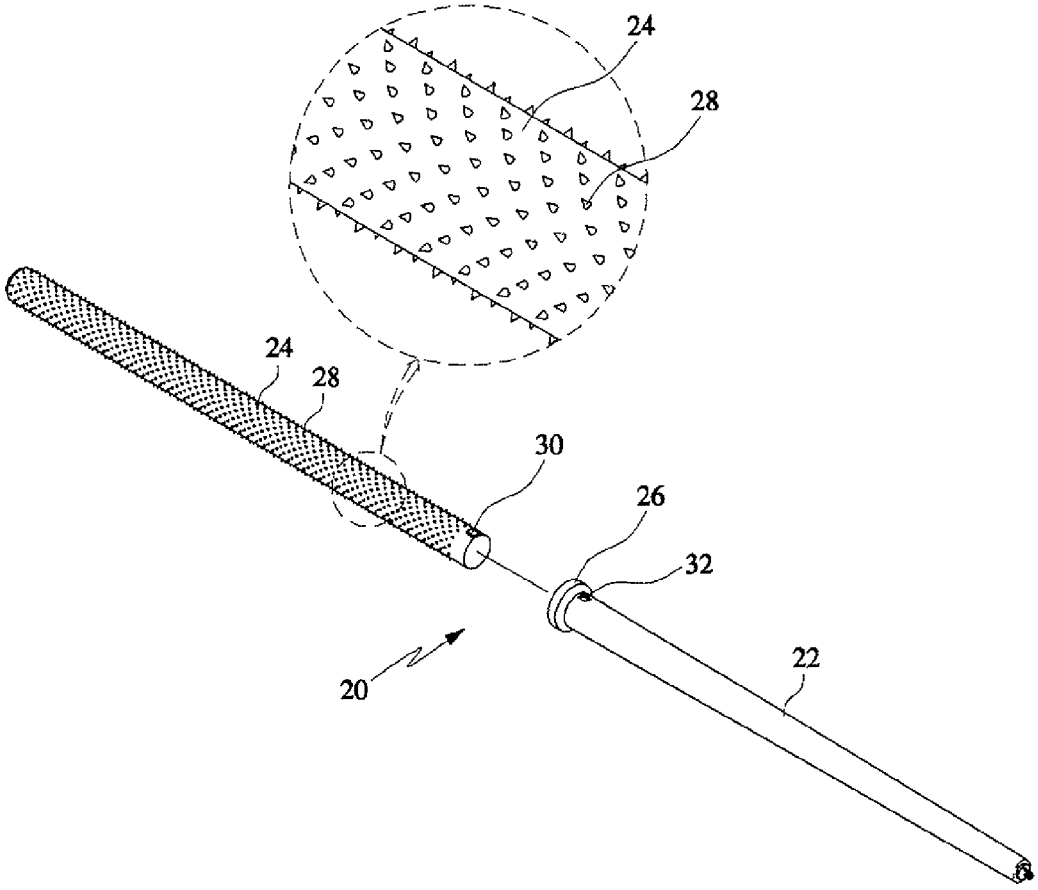
FIG. 6 is a perspective view of the rod of FIG. 4A being separated.

FIG. 6 illustrates a separation of the rod 20 of FIG. 4A. A fixing rise 30 is formed at one end of the brush securing part 24. Corresponding to the fixing rise 30, a fixing hole 32 is formed at one end of the handle part 22. When contacting the handle part 22 with the brush securing part 24 and strongly pushing the handle part 22, the fixing hole 32 is elastically deformed to be expanded so that the fixing rise 30 is press-fitted into the fixing hole 32. Since the brush securing part 24 and the handle part 22 are separated from each other in the rod 20 as described above, upon packing, the volume of the product is reduced as much as the handle part 22 which is separated. Upon use, a user combines the brush securing part and the handle part of the rod 20.

Figure 7:
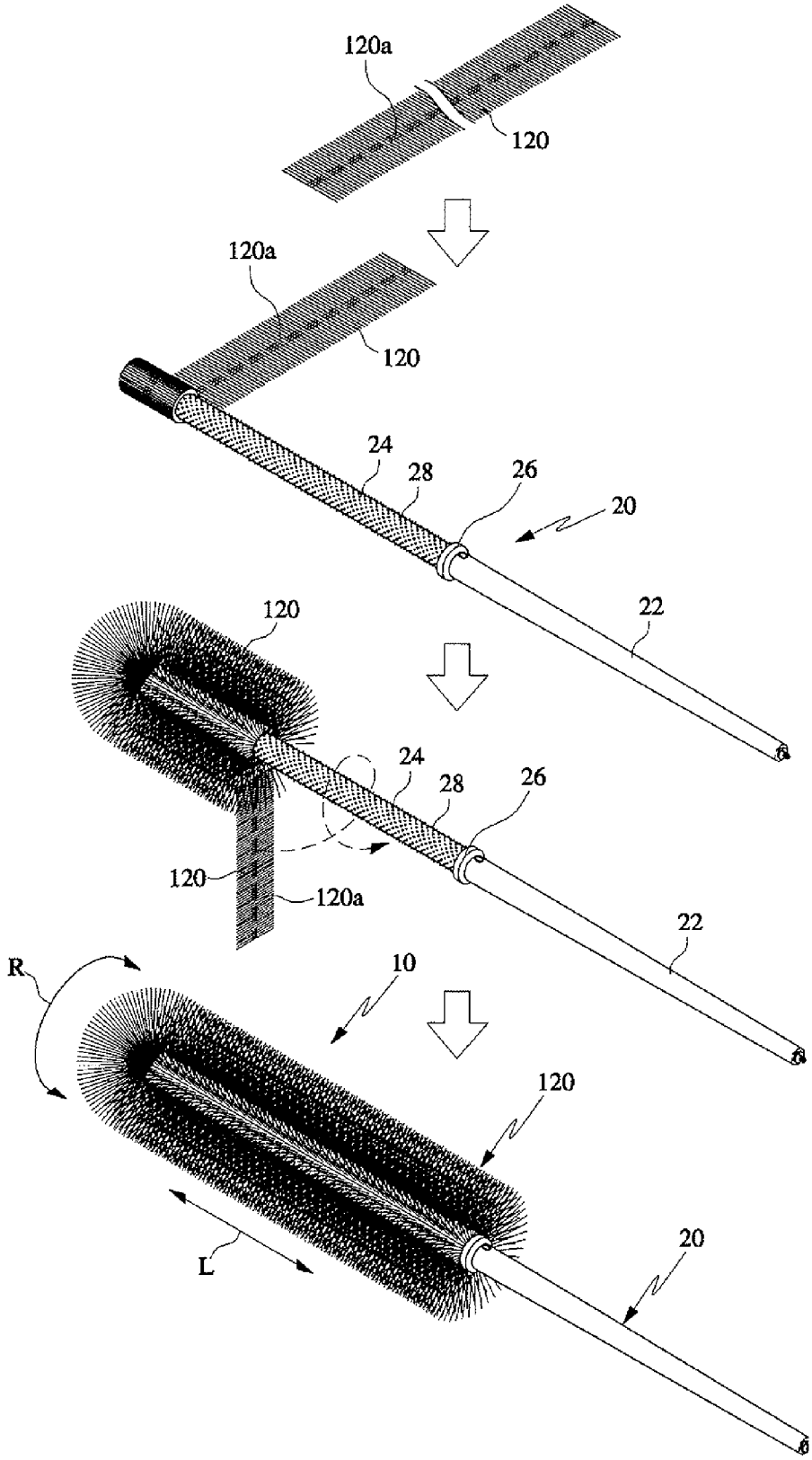
FIG. 7 is a view illustrating a process of assembling a duster according to the present invention.

FIG. 7 illustrates a process of assembling a duster 10 of the present invention.

Figure 1:
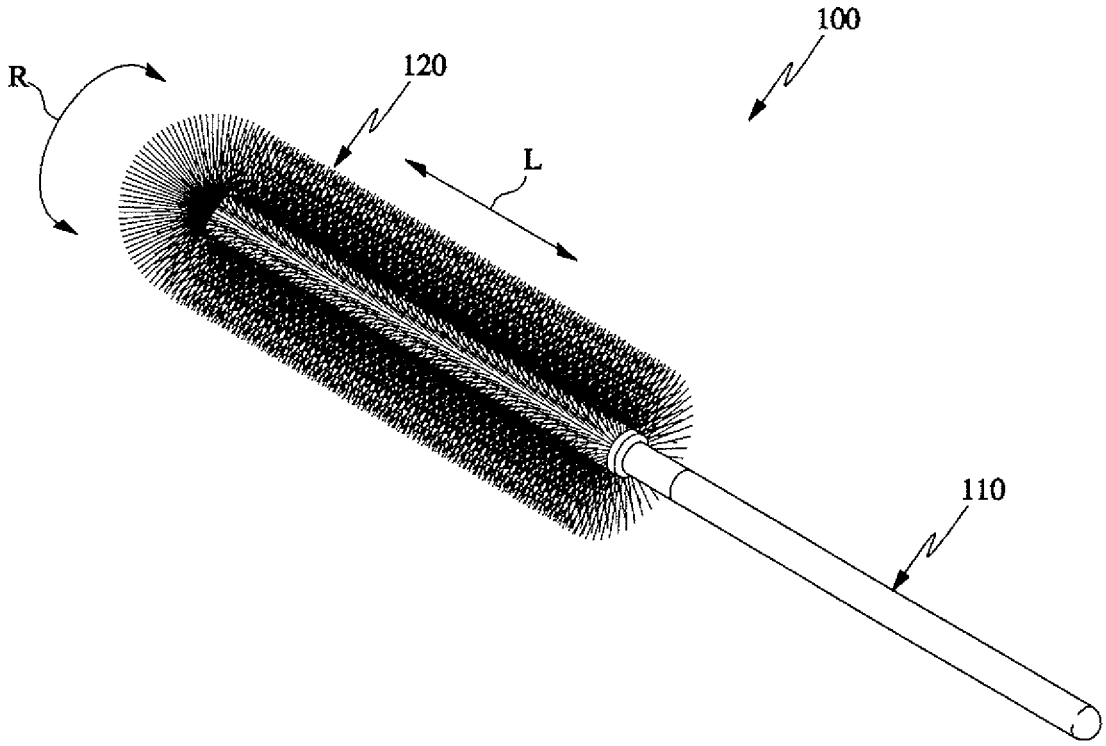
FIG. 1 (CONVENTIONAL ART)
FIG. 1 is a perspective view of a conventional duster.
Figure 2:
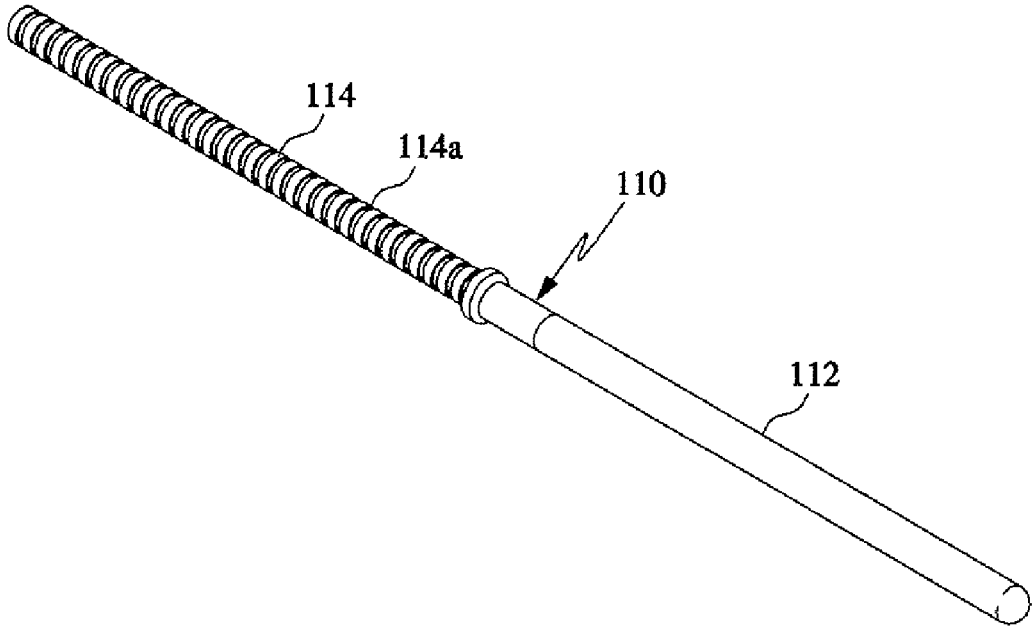
FIG. 2 (CONVENTIONAL ART)
FIG. 2 is a perspective view of a rod of the conventional duster.
Figure 3:
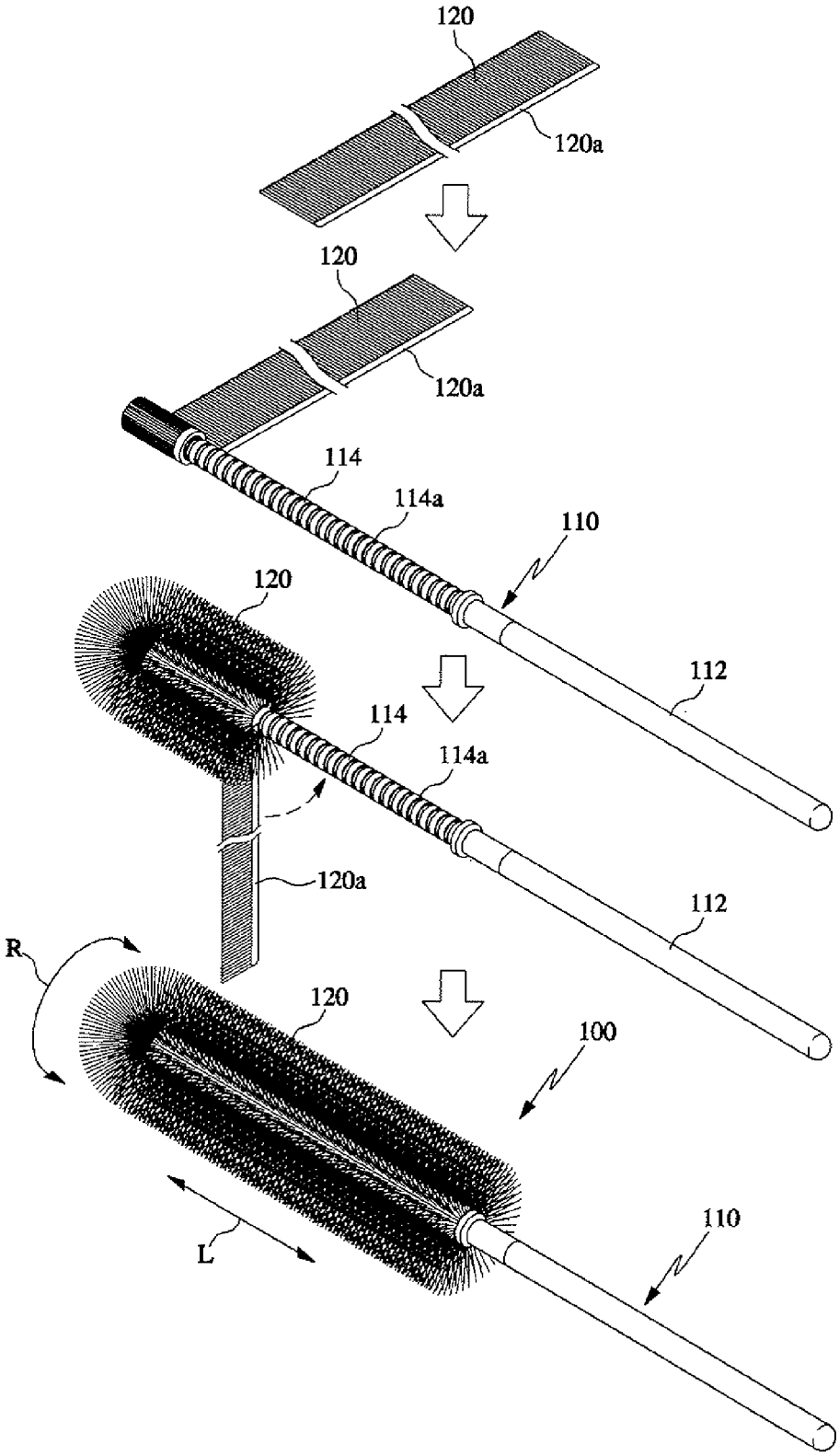
FIG. 3 (CONVENTIONAL ART)
FIG. 3 is a view illustrating a process of assembling the conventional duster.

A brush 120 is prepared as shown. The brush 120 is similar to that of the conventional duster which has been described with reference to FIG. 3. However, in the present invention, the brush 120 comprises a stitching line 120*a*. The stitching line 120*a* is formed by stitching the middle of a plurality of filaments. The brush 120 is secured, by being wound around a brush securing part 24 of a rod 20. Then, the brush 120 is wound while the stitching line 120*a* is stuck to sharp protrusions 28, so that the brush 120 does not slip in the direction of the length (L) and the direction of the axial rotation (R) of the rod 20.

Figure 8:
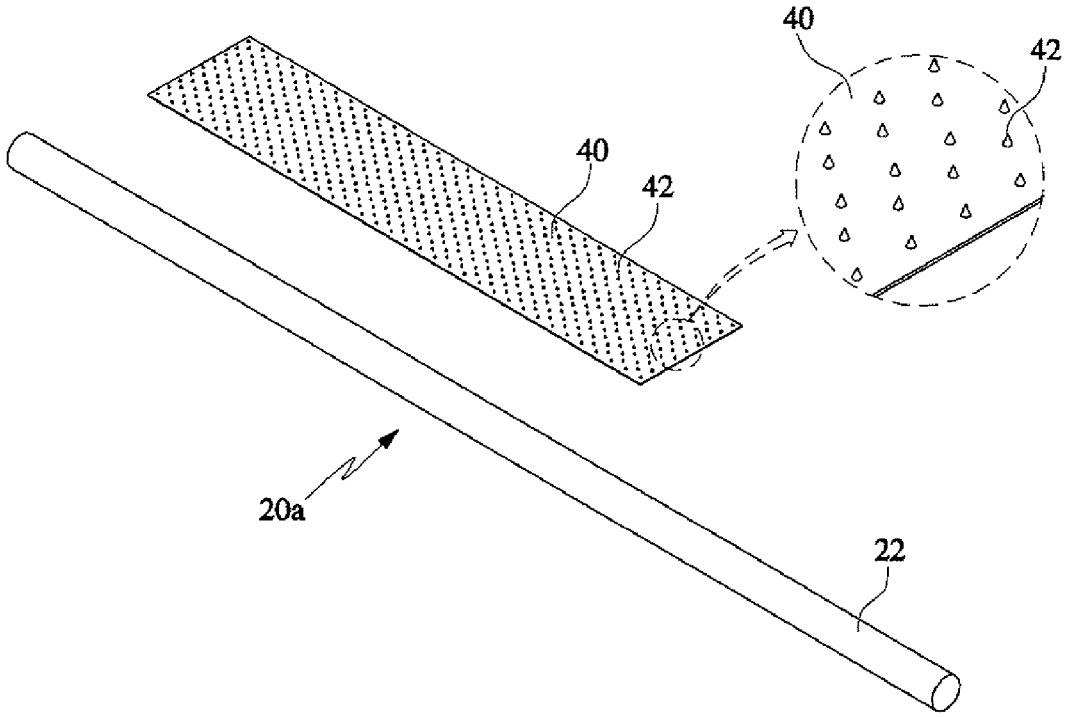
FIG. 8 is a perspective view of a rod of a duster according to a second embodiment of the present invention.
Figure 9:
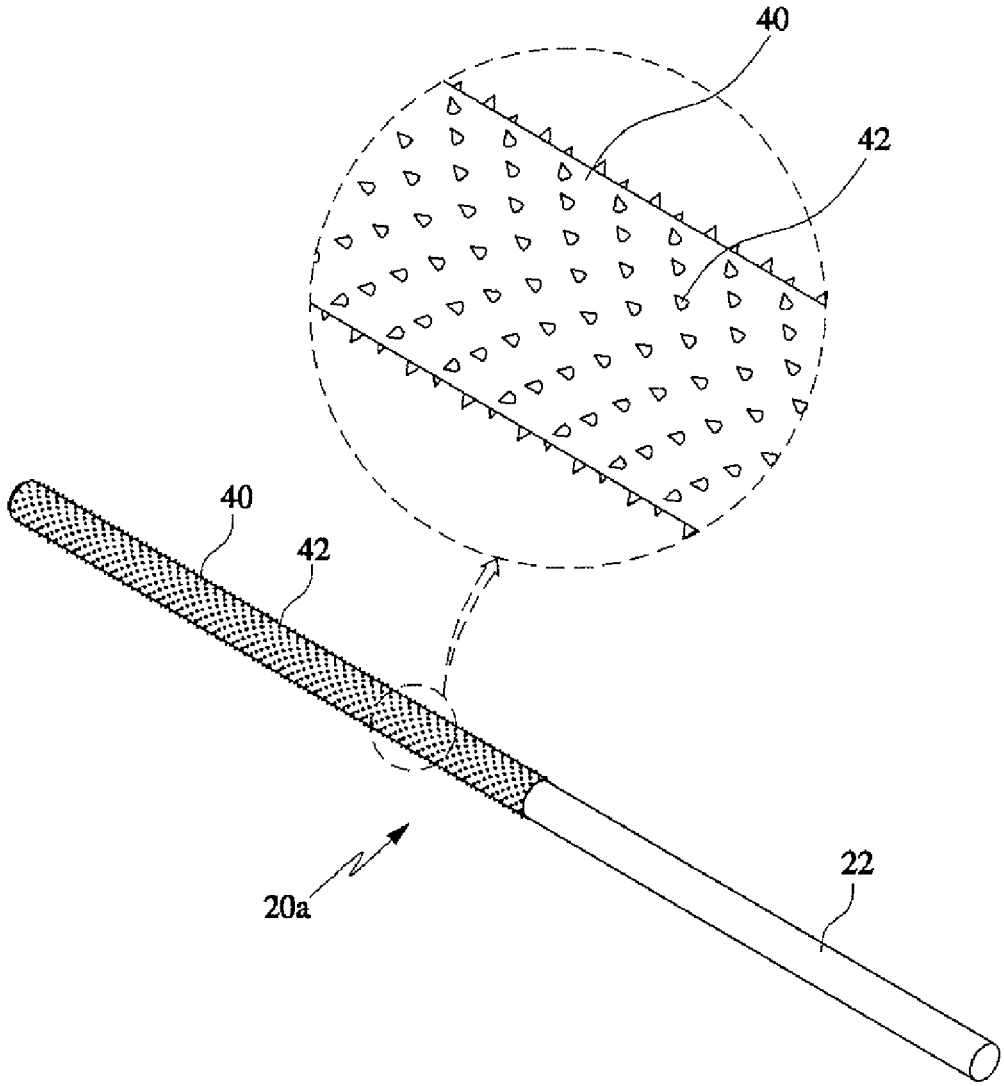
FIG. 9 is a perspective view of the rod of FIG. 8 being connected.

FIGS. 8 and 9 illustrate a rod 20*a* according to a second embodiment of the present invention.

When a rod 20*a* is mainly made of wood or metal, it is difficult to form protrusions in one body with a brush securing part. Considering this case, the second embodiment of the present invention provides the rod 20*a*.

The rod 20*a* is generally made of wood or metal and includes a handle part 22 and a brush securing part, both being formed in one body.

Reference numeral 40 indicates a wraparound sheet 40. A number of sharp protrusions 42 are formed on the surface of the wraparound sheet 40. The wraparound sheet 40 is adhesively wound around the entire outer surface of the brush securing part of the rod 20*a*, by using an ordinary adhesive agent.

Preferably, the wraparound sheet 40 may be made of a plastics material which is suitable to be adhesively wound around the outer surface of the rod 20*a*. The protrusions 42 may be conical or cylindrical.

The rod 20*a* is assembled by the process of FIG. 7, as described above, to complete the duster 10.

Figure 10:
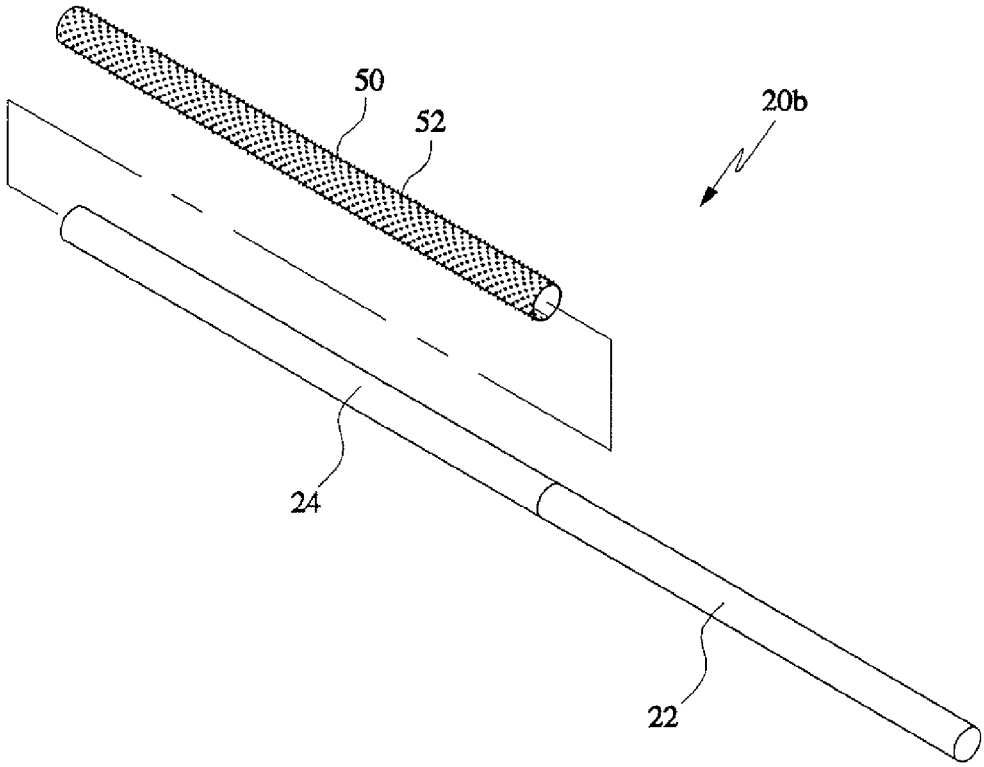
FIG. 10 is a perspective view of a rod of a duster according to a third embodiment of the present invention.
Figure 11:
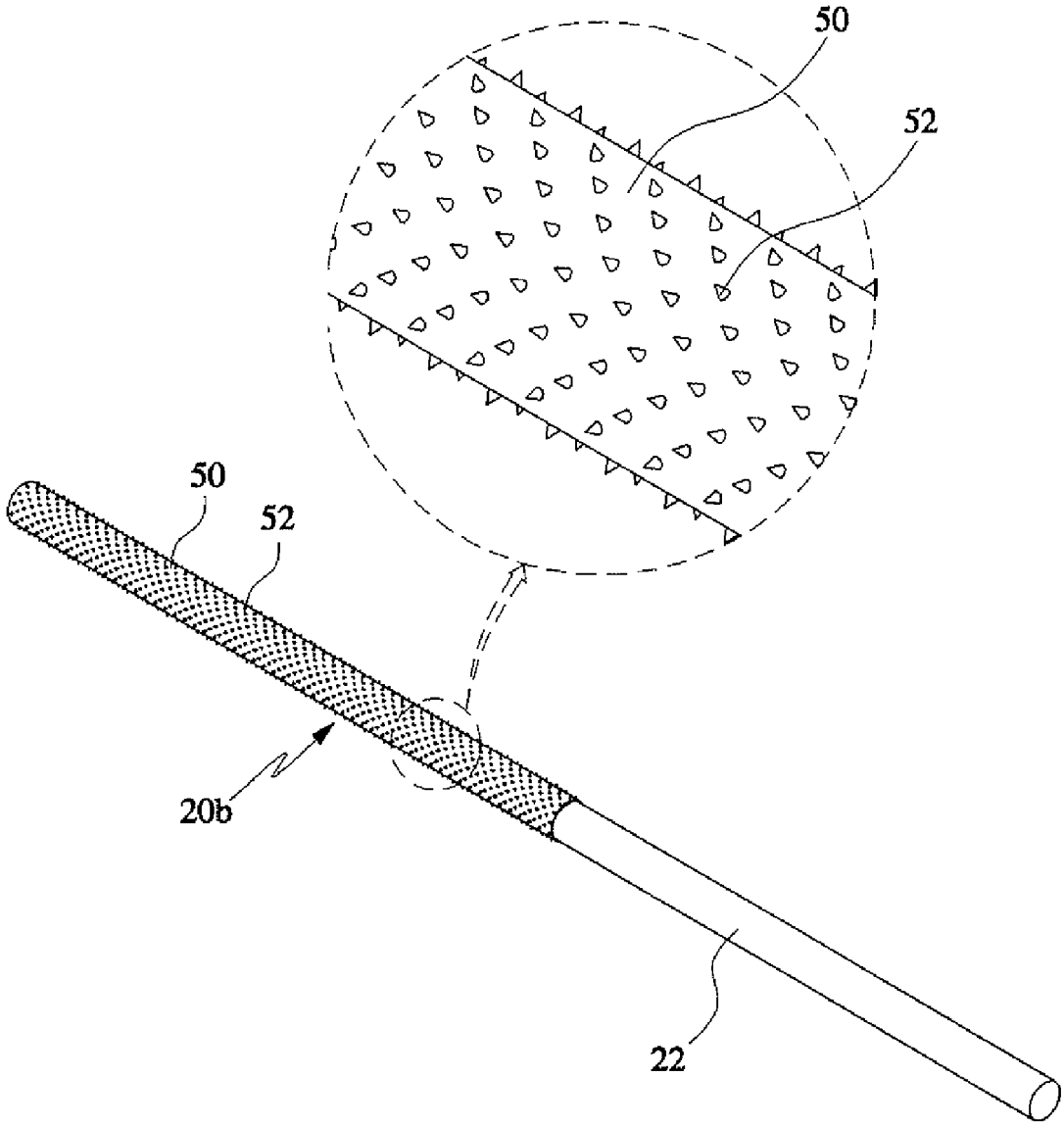
FIG. 11 is a perspective view of the rod of FIG. 10 being combined.

FIGS. 10 and 11 illustrate a rod 20*b* according to a third embodiment of the present invention.

When a rod is mainly made of wood or metal, it is difficult to form protrusions in one body with the rod. Considering this case, the third embodiment of the present invention provides the rod 20*b*.

The rod 20*b* is generally made of wood or metal and includes a handle part 22 and a brush securing part 24, both being formed in one body.

Reference numeral 50 indicates a tube-type brush securing case. A number of sharp protrusions 52 are protruded from and formed on the entire outer circumference surface of the tube-type brush securing case 50. The tube-type brush securing case 50 is adhesively fitted into the outer surface of the brush securing part 24.

When assembling the brush securing case 50 and the brush securing part 24, the brush securing case 50 may be adhesively fixed to the brush securing part 24, by using an ordinary adhesive agent, the brush securing case 50 may be fixedly press-fitted into the brush securing part 24, or the brush securing case 50 may be fixed to the brush securing part 24, by using other general assembling methods, that is, by forming a protruding rise (not shown) on the brush securing part 24, and, correspondingly to the rise, forming a hole (not shown) to receive the rise, on the brush securing case 50, so that the rise is inserted into the hole.

The rod 20*b* is assembled by the process of FIG. 7, as described above, to complete the duster 10.

The above-described protrusions 52 may be conical or cylindrical in shape.

Reference numeral 34 described with reference to FIG. 5A indicates a connection ring which is used, by connecting a string to the ring.

As described above, in the duster according to the present invention, since the protrusions are formed in the brush securing part of the rod at which the brush is secured, the stitching line is stuck to the protrusions. Accordingly, the brush secured at the brush securing part, by being wound around the rod, is prevented from slipping in the direction of the length and the direction of the axial rotation of the rod. Furthermore, since the slip of the brush in the aforementioned directions is prevented by using no adhesive agent, the work efficiency, which would be deteriorated due to the use of an adhesive agent, is significantly improved, and the cost is greatly reduced by no use of the adhesive agent. Furthermore, since the wraparound sheet including protrusions or the tube-type brush securing case as well as plastics are selectively usable as a material of the rod, a duster can be manufactured, by using the rod made of wood or metal.

The scope of the claims, therefore, should be accorded the broadest interpretation so as to encompass all such modifications and similar arrangements.

What is claimed is:

1. A duster comprising:

a rod including a handle part and a brush securing part;

and a brush being secured to the brush securing part of the rod, wherein a number of protrusions are protruded from all over the outer surface of the brush securing part of the rod, to be formed in one body with the brush securing part; and a single stitching line of the brush is stuck to the protrusions by being inserted between the protrusions, to be wound around the brush securing part from a first end of the brush securing part to a second end of the brush securing part opposite the first end, wherein the single stitching line is formed by stitching the middle of a plurality of filaments in all area of the brush, so that the brush is prevented from slipping in the direction of the length and in the direction of the axial rotation of the rod.

2. The duster of claim 1, wherein the protrusion is conical in shape.

3. The duster of claim 1, wherein the protrusion is cylindrical in shape.

4. The duster of claim 1, wherein the rod comprises:

a fixing rise formed at one end of the brush securing part; and a fixing hole formed at one end of the handle part, corresponding to the fixing rise, so that the handle part and the brush securing part are separable from each other and connectable to each other.

5. The duster of claim 1, wherein the rod is made of plastics.

6. A duster comprising:

a rod including a handle part and a brush securing part; and a brush being secured to the brush securing part of the rod, wherein a wraparound sheet is attached all over to the outer surface of the brush securing part of the rod;

a number of protrusions are protruded from all over the surface of the wraparound sheet;

a single stitching line of the brush is stuck to the protrusions by being inserted between the protrusions, to be wound around the brush securing part from a first end of the brush securing part to a second end of the brush securing part opposite the first end, wherein the single stitching line is formed by stitching the middle of a plurality of filaments in all area of the brush, so that the brush is prevented from slipping in the direction of the length and in the direction of the axial rotation of the rod.

7. The duster of claim 6, wherein the protrusion is conical in shape.

8. The duster of claim 6, wherein the protrusion is cylindrical in shape.

9. The duster of claim 6, wherein the rod is made of wood or metal.

10. A duster comprising:

a rod including a handle part and a brush securing part; and a brush being secured to the brush securing part of the rod, wherein a tube-type brush securing case is attached to cover all of the outer surface of the brush securing part of the rod;

a number of protrusions are protruded from all over the surface of the brush securing case; and a single stitching line of the brush is stuck to the protrusions by being inserted between the protrusions, to be wound around the brush securing part from a first end of the brush securing part to a second end of the brush securing part opposite the first end, wherein the single stitching line is formed by stitching the middle of a plurality of filaments in all area of the brush, so that the brush is prevented from slipping in the direction of the length and in the direction of the axial rotation of the rod.

11. The duster of claim 10, wherein the protrusion is conical in shape.

12. The duster of claim 10, wherein the protrusion is cylindrical in shape.

13. The duster of claim 10, wherein the rod is made of wood or metal.

* * * * *